US008677757B2

(12) United States Patent
Sadig et al.

(10) Patent No.: US 8,677,757 B2
(45) Date of Patent: Mar. 25, 2014

(54) COMBUSTION CHAMBER HEAD OF A GAS TURBINE

(75) Inventors: Sermed Sadig, Berlin (DE); Miklos Gerendas, Am Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 945 days.

(21) Appl. No.: 12/774,214

(22) Filed: May 5, 2010

(65) Prior Publication Data

US 2011/0005233 A1 Jan. 13, 2011

(30) Foreign Application Priority Data

Jul. 8, 2009 (DE) ..... 10 2009 032 277

(51) Int. Cl.
*F02C 1/00* (2006.01)
*F02C 7/24* (2006.01)

(52) U.S. Cl.
USPC ..... 60/752; 60/725; 60/726; 60/756

(58) Field of Classification Search
USPC ..... 60/722–727, 737, 746, 747, 748, 804, 60/752–760
See application file for complete search history.

(56) References Cited

U.S. PATENT DOCUMENTS

| | | | | |
|---|---|---|---|---|
| 4,689,961 | A * | 9/1987 | Stratton | 60/748 |
| 5,253,471 | A | 10/1993 | Richardson | |
| 5,329,761 | A | 7/1994 | Ablett et al. | |
| 5,363,654 | A | 11/1994 | Lee | |
| 5,490,389 | A | 2/1996 | Harrison et al. | |
| 5,765,376 | A | 6/1998 | Zarzalis et al. | |
| 5,956,955 | A | 9/1999 | Schmid | |
| 6,018,950 | A | 2/2000 | Moeller | |
| 6,035,645 | A | 3/2000 | Bensaadi et al. | |
| 6,546,733 | B2 | 4/2003 | North et al. | |
| 7,665,306 | B2 | 2/2010 | Bronson et al. | |
| 2007/0113556 | A1 | 5/2007 | Biebel et al. | |
| 2007/0169992 | A1 | 7/2007 | Wasif et al. | |

FOREIGN PATENT DOCUMENTS

| | | |
|---|---|---|
| CA | 2627627 | 12/2008 |
| DE | 4427222 | 2/1996 |
| DE | 69406975 | 5/1998 |
| DE | 102006048933 | 4/2008 |

(Continued)

OTHER PUBLICATIONS

German Search Report dated Jan. 10, 2012 from counterpart patent application.

(Continued)

*Primary Examiner* — Ehud Gartenberg
*Assistant Examiner* — Arun Goyal
(74) *Attorney, Agent, or Firm* — Timothy J. Klima; Shuttleworth & Ingersoll, PLC

(57) ABSTRACT

A combustion chamber head of a gas turbine has a confinement enclosing a dampening volume (207) and including a combustion chamber-opposite confinement (206) and a combustion chamber-side confinement (210). The combustion chamber-side confinement (210) is provided as perforated wall (210). In the edge area of the combustion chamber-side confinement (210), cooling air can be routed onto the combustion chamber-side confinement (210) via recesses (203) in the confinement (206). This cooling air, which flows along the combustion chamber-side confinement (210), crosses the cooling air flow through the perforated wall (210) in the combustion chamber (101) without mixing with the latter, as both are separated by walls.

13 Claims, 6 Drawing Sheets

(56) References Cited

FOREIGN PATENT DOCUMENTS

Figure 1:
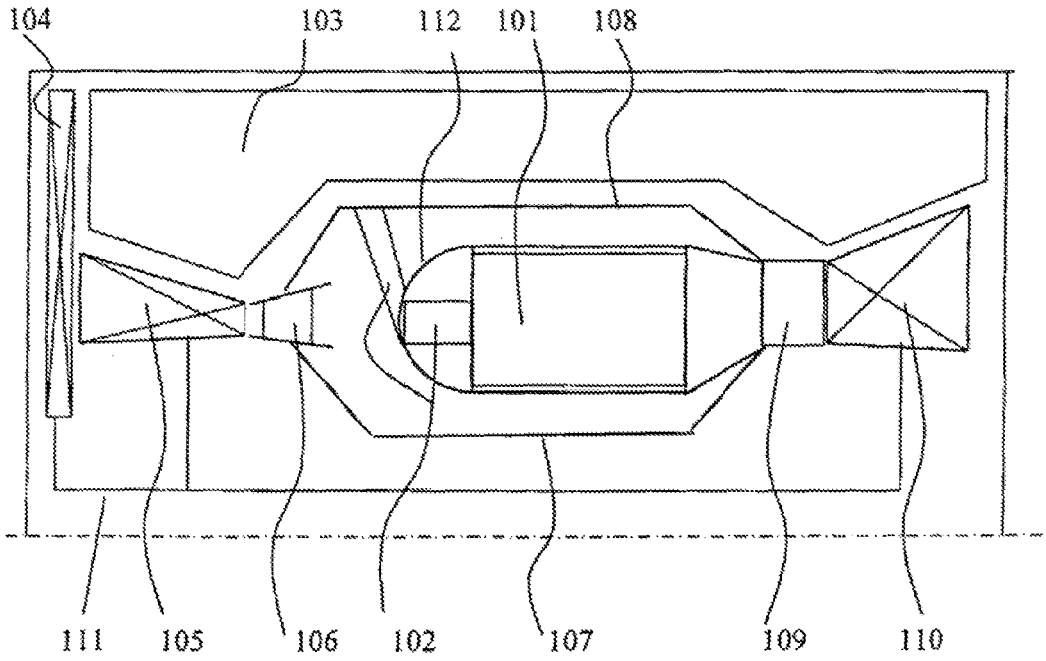

| | | |
|---|---|---|
| EP | 0042044 | 12/1981 |
| EP | 0576717 | 1/1994 |
| EP | 0971172 | 1/2000 |
| EP | 1785671 | 5/2007 |
| WO | 9216798 | 10/1992 |

OTHER PUBLICATIONS

German Search Report dated Feb. 10, 2010 from counterpart patent application.

Jeff D. Eldredge and Ann P. Dowling, "The Absorption of Axial Acoustic Waves by a Perforated Liner with Bias Flow", J. Fluid Mech. (2003), vol. 485, pp. 307-335, Cambridge University Press.

* cited by examiner

COMBUSTION CHAMBER HEAD OF A GAS TURBINE

This application claims priority to German Patent Application DE102009032277.9 filed Jul. 8, 2009, the entirety of which is incorporated by reference herein.

This invention relates to a combustion chamber head of a gas turbine.

The arrangement of a conventional heat shield for the combustion chamber head is shown in Specification DE 44 27 222 A. Such a heat shield protects the combustion chamber head against hot gases and is to be cooled on the side facing away from the combustion chamber interior. For this, cooling air is supplied to the rear side of the heat shield, impinges thereon, and flows around a multitude of cylinders provided to augment the transfer of heat. Subsequently, the cooling air leaves the space between the heat shield and the combustion chamber head through inclined effusion holes showing in the direction of the burner swirl.

Also known is a combustion chamber head including an end wall, a front plate and a heat shield. This is a three-wall arrangement of a combustion chamber head with open volume between the end plate and the front plate. The purpose of the end plate is to conduct the flow of air coming from the compressor.

The principle of an impingement-effusion cooled combustion chamber wall element is explained in Specification WO 92/16798 A. Cooling air flows through orthogonal holes in an outer wall and impinges on an inner wall. Both walls form a closed volume which is left by the cooling air via inclined effusion holes. In the process, a cooling film forms on the hot side of the inner wall protecting the latter against the hot combustion gases.

In other publications, for example EP 0 971 172 A, the principle of the impingement-effusion cooled combustion chamber wall has been expanded by the aspect of dampening combustion chamber vibrations. Here, the effusion holes, together with the volume enclosed by the walls containing the impingement and effusion holes, form a multitude of interconnected Helmholtz resonators. This arrangement enables high-frequency oscillations in the area of 5 kHz to be dampened. The distance of the dampening holes from one another and the distance of the walls are variable to provide a broad dampening spectrum.

In their publication of 2003 "The absorption of axial acoustic waves by a perforated liner with bias flow" (J. Fluid Mech. (2003), vol. 485, pp. 307-335, Cambridge University Press), Eldredge and Dowling provided a model for describing the broad-band acoustic dampening effect of perforated wall elements. According to this, the absorption of acoustic vibrations by perforated wall elements is large and has broad-band effect with a single-wall arrangement under plenum flow. If a second wall is introduced, as on the impingement-effusion arrangement, absorption is significantly influenced by the wall including the impingement cooling holes. Increasing distance allows the influence to be reduced and brought close to the dampening effect of a single-wall damper. In this context, plenum flow means that no significant pressure or velocity variations exist in this volume (it does not resonate!), quite contrary to a Helmholtz resonator. Also, owing to the broad-band nature of the effect, adjustment of the volume to the frequency to be dampened is here not required, other than with a Helmholtz resonator. In addition, the volume used for the damper is distinctly smaller than calculated from the equation for the relation of resonator volume and frequency known from literature.

A possible arrangement for providing an enlarged dampening volume is shown in Specification EP 0 576 717 A. Here, an additional volume providing for the formation of a Helmholtz resonator volume is connected to a double-wall element. The resonator volume is dimensioned in accordance with the wave lengths occurring.

Specification CA 26 27 627 A shows a heat shield provided with fins on the side facing away from the combustion chamber. The fins are connected to each other at one end, with their open side showing to the combustion chamber inner and outer walls. Cooling air impinges between the fins and is conducted by the fins to the combustion chamber walls. The objective of this arrangement is to prevent the impingement-cooling jets from excessively affecting each other. It is thereby intended to avoid the effects of the entering cross flow.

Specification US 2007/0169992 A deals with the problem of combining a high impingement cooling effect with a large distance of the impingement and effusion walls ensuring a large damper volume. The solution proposed provides for bridging the distance between the two wall elements by tubes directed from the cold combustion chamber outer wall to the hot combustion chamber wall to enable an optimum impingement cooling distance while maintaining a large damper volume.

Conventional heat shields, as provided for example in DE 44 27 222 A, have a small distance between head plate and heat shield. This is required to obtain adequate impingement cooling effect (WO 92/16798). In order to make use of the viscous dampening effect of a perforated hole plate, a large dampening volume is, however, to be provided behind the heat shield (Eldredge and Dowling 2003). Otherwise, only high-frequency shares of the combustion chamber oscillations would be dampable by application of the principle of coupled Helmholtz resonators (EP 0 971 172 A). If an additional volume is connected to a double-wall element (EP 0 576 717 A), this volume is required to be trimmed to a frequency expected, this thwarting the advantage of a perforated wall element as damper. Since both wall elements are still situated close to each other, the negative influence of the outer impingement-cooling wall cannot be excluded.

The inclined effusion holes shown in the above mentioned publications provide for high film-cooling efficiency. However, the dampening effect obtained therewith is inferior to vertical holes. It can therefore be stated that the requirements on the dampening and cooling effects are in conflict.

The combustion chamber head with the additional, flow-conducting end plate shown in Specification DE 44 27 222 A is disadvantageous in that the volume between end plate and front plate does not represent a closed volume decoupled from the burner. It may therefore occur that pressure variations in this volume affect the stability of the burner. Accordingly, the end plate is only intended as a flow-conducting element.

The arrangement according to Specification US 2007/0169992 A provides for a high impingement-cooling effect while maintaining a large damper volume. However, since every impingement-cooling hole is to be connected to a tube, this arrangement is very complex and, with several thousand impingement-cooling holes, basically impracticable for installation in a combustion chamber. Furthermore, the length of the tube arrangement entails a loss of volume, so that this method is ineffective.

A broad aspect of the present invention is to provide a combustion chamber head of the type specified at the beginning, which satisfies the thermal requirements and ensures a high dampening effect, while being simply designed and easily and cost-effectively producible.

According to the present invention, it is therefore provided that the combustion chamber head forms a volume which is confined to the combustion chamber by a wall, with the airflow for cooling the confinement and the airflow through the wall for dampening the vibrations crossing each other on the flame-opposite side of this confinement without mixing with each other.

According to the present invention, provision is thus made for highly effective acoustic dampening in combination with excellent thermal shielding of the structure against the heat in the combustion chamber.

Figure 2:
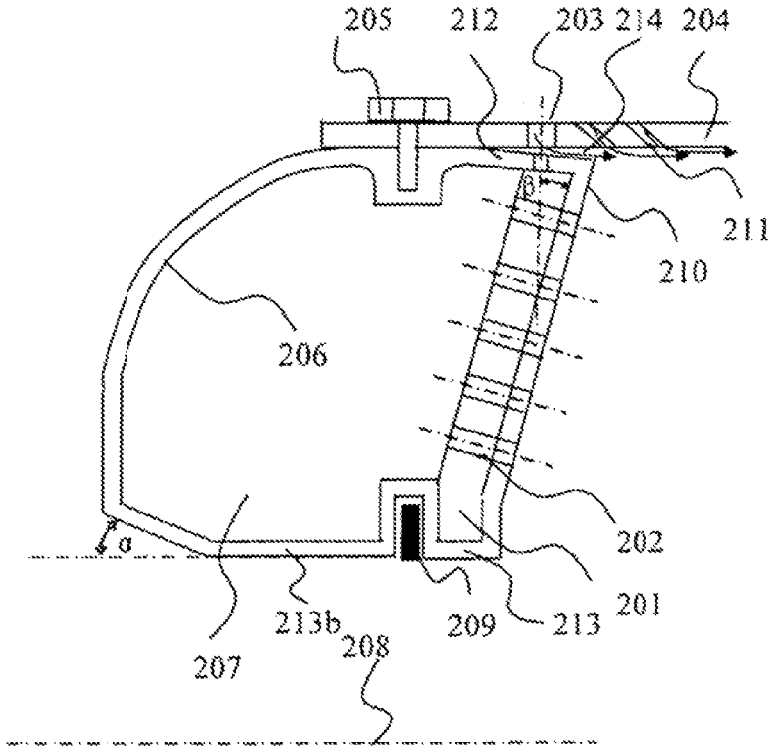

The present invention is more fully described in light of the accompanying drawing showing preferred embodiments. In the drawing, FIG. 1 is a schematic representation of a gas turbine in accordance with the present invention with a combustion chamber head according to the state of the art, FIG. 2 is an enlarged detail view of an inventive design of the combustion chamber head, FIGS. 3*a*-3*e* are detail views of the surface structure of the heat shield, FIGS. 4*a*-4*d* are perspective representations of heat transfer elements analogically to FIGS. 3*a*-3*e*, and FIGS. 5*a*-5*c* are further examples of the transition between combustion chamber wall and heat shield.

The combustion chamber head according to the present invention is first described in connection with a schematic representation of a gas turbine with reference being made to FIGS. 1-3.

The combustion chamber head includes a hot gas-facing, perforated wall 210 and a confinement 206 enclosing the volume 207. An enclosed volume 207 is formed. The perforated wall 210 features fins 201. Holes 202 in the wall 210 preferably extend through the fins 201.

The air required for flowing the combustion chamber head gets into the combustion chamber head 112 via lateral entries 203. In the process, a jet is produced which impinges onto the wall 210 at an angle β of 0-80°.

Figure 4A:
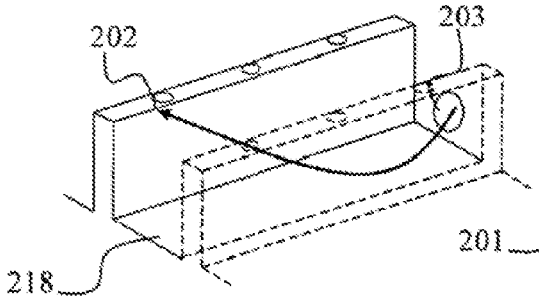
Figure 4B:
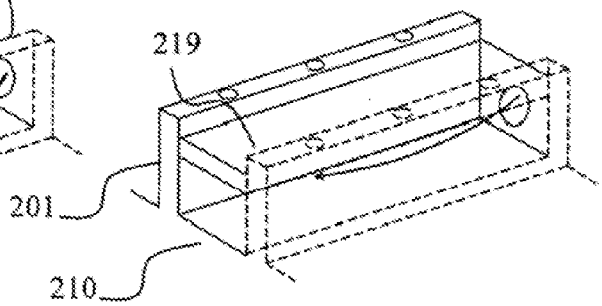

Between two fins, a flow duct is formed in which a flow with increased velocity is generated (see FIG. 4*a*). This flow absorbs heat via the fins, thereby cooling the component.

In dependence of the hole diameter of the entry hole 203 and the local pressure level, the air jet will lift off from the wall 210 after a characteristic running length and enter the volume 207.

According to the present invention, the flow duct 218, which is formed by fins or heat transfer elements (see FIGS. 4*a* and 4*b*), can be complemented by a cover 219, thereby providing a partly closed flow duct. Thus, the air jet is routed close to the wall 210, attaching the fins 201.

Figure 4C:
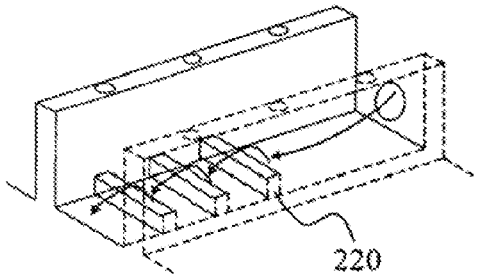

Also, according to the present invention, heat transfer-augmenting elements 220 can additionally be arranged in the flow duct 218 or at the fins 201 to increase the transfer of heat at the combustion chamber-side confinement, see FIG. 4*c*, for example.

Accordingly, the flow initially runs parallel to the wall 210, lifts off from the wall 210 (combustion chamber-side confinement) and enters the volume 207, where it leaves the combustion chamber head through the holes 202 in the wall. The entering and exiting air mass flows, while crossing each other in their direction of movement, will not mix with each other as they are separated by walls. As a result of the different direction of movement and conductance of the air stream in the combustion chamber head, clear separation between the cooling and dampening function is provided.

The volume 207 is preferably dimensioned such that a plenum-near inflow is ensured for the exit holes 202. This applies if the supply air no longer influences the flow to the exit holes 202. A distance of min. 2 mm to max. the length of the burner 102 can be selected. In order to obtain a broad-band dampening effect, the size of the dampening volume is, other than with Helmholtz resonators, selected independently of the resonance frequencies to be expected. The volume required for a Helmholtz resonator is calculated from $$V = \left(\frac{a_0}{2\pi f}\right)^2 \frac{S_0 \sigma}{l_{eff}}$$

with a0 being the velocity of sound, f the resonance frequency, S0 the cross-sectional area of the resonator neck, and leff the resonator neck length. It is frequency-dependent and substantially larger than the volume 207 here required.

The volume 207 can be provided as circumferentially continuous volume. The volume 207 is segmentable by additional separating walls into individual volumina confined from each other. In the case of a segmented volume 207, the volumina are equally or differently dimensionable.

To provide for optimum cooling effect along the entire wall 210, the height of the fins 201 is preferably selected such that lift-off of the air jet from the entry holes 203 occurs as far as possible downstream of the supply air holes 203. In particular, heights of 1 mm to 10 mm are here seen as advantageous.

Figure 3A:
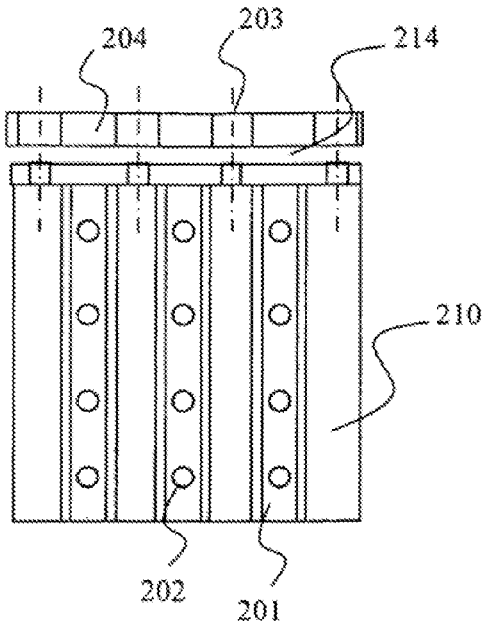
Figure 3B:
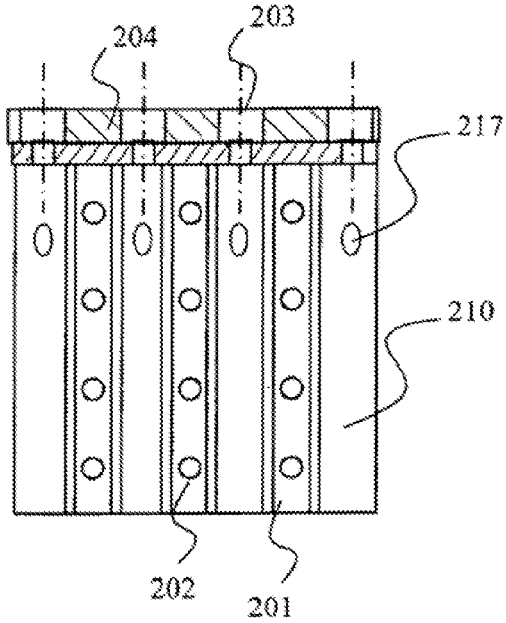
Figure 3C:
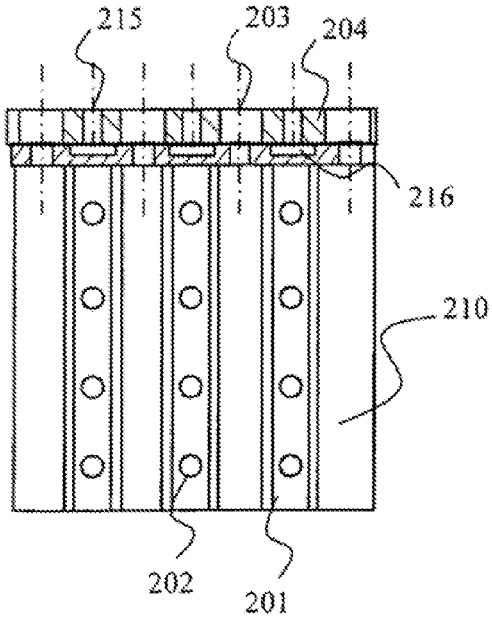
Figure 3D:
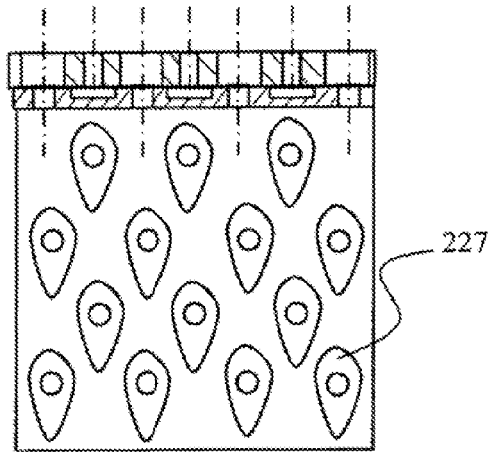
Figure 3E:
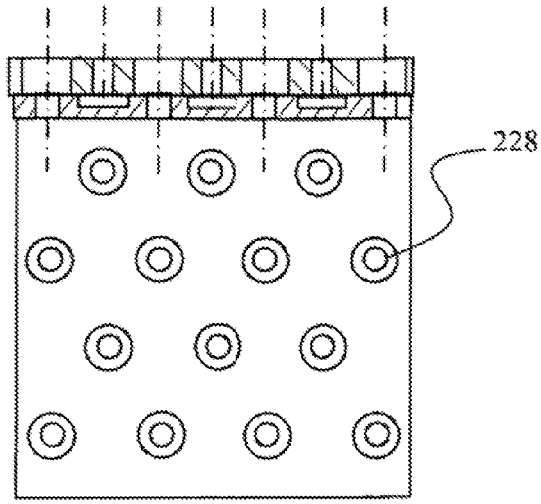
Figure 4D:
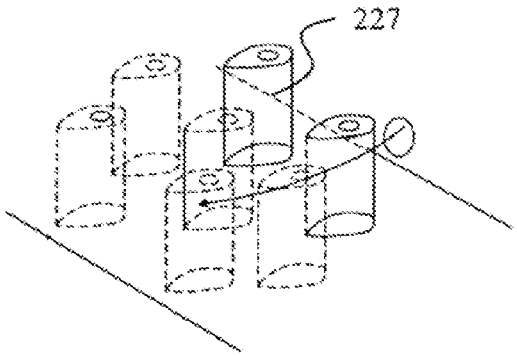
Figure 4E:
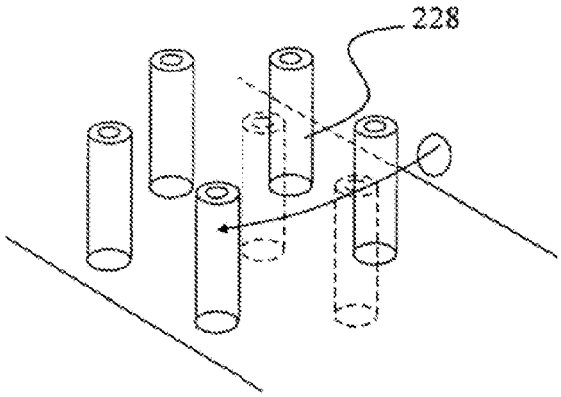

Alternatively, individual or also groups of exit holes 202 can extend through individual fin elements 227 and 228. The arrangement of the fin elements is optional. The shape of the cross-section of the fin elements is optional. Function will not be impaired thereby. By way of example, an aerodynamic profile is shown in FIGS. 3*d* and 4*d* and a circular profile in FIGS. 3*e* and 4*e*. Rectangular, rhombic, hexagonal, elliptic, prismatic profiles are also employable. Also, a combination of the above profiles can be used, as are profiles formed by intersection of circular segments.

The entries (entry recess 203) can optionally be placed near the burner 102 over the inner sidewall of the combustion chamber head 213, with flow then being routed along the fins in the direction of the outer sidewall of the combustion chamber head 112.

The arrangement can be conceived 'one-piece' as integral component or 'multiple-piece' from several components, with attention to be paid to adequate sealing. The combustion chamber head is attached to the combustion chamber wall, preferably by at least one fastener each.

The effective area of the exit holes 202 exceeds that of the supply air holes 203 by preferably a factor of 2-10.

Figure 5A:
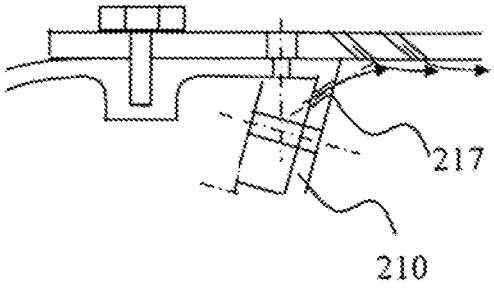
Figure 5B:
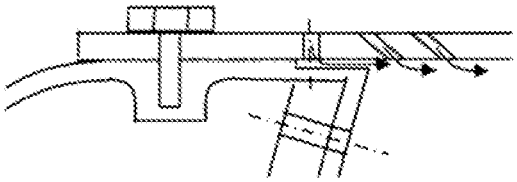
Figure 5C:
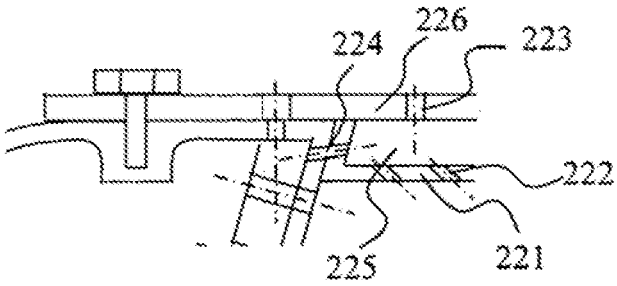

Setting a gap 214 between the combustion chamber wall 204 and the outer sidewall at the level of the entry hole 203 (see FIG. 2 and FIG. 3*a*) enables an initial cooling film to be placed on the combustion chamber wall 204. Functionally substituting for the initial cooling film, an effusion hole 217 inclined in the direction of the combustion chamber wall is alternatively integratable into the wall 210 (FIGS. 3*b* and 5*a*, for example). In this case, the outer sidewall of the combustion chamber head plate lies on the combustion chamber outer wall. The effusion hole can optionally extend through the wall 210 or the fin 201. Further, additional holes 215 (see FIG. 3*c*) are integratable into the combustion chamber wall 204. These will then not issue into the entry holes of the combustion chamber head, but in a groove 216 disposed in the sidewall 204. The groove is continuous in the sidewall in the direction of the wall 210. The air flows through the hole 215, impinges onto the sidewall 212, and enters the combustion chamber via the groove 216 (see FIG. 5*b*).

In order to ensure adequate flow to the burner, the wall 213*b* may be inclined at an angle α relative to the burner axis 208. Optionally, a rounding is providable in lieu of, or, in addition to the angle.

Alternatively, the combustion chamber wall 204 may be of the two-wall type, including an inner wall 221 facing the hot gas and a wall 226 facing the cold outward flow. The combustion chamber outer and the inner walls may optionally be perforated (see reference numerals 222 and 223 in FIG. 5*c*). The volume 225 formed between the combustion chamber outer and inner walls is connectable to the volume 207 via a flow duct 224.

The arrangement described herein enables an adequately cooled damper element, which provides for highly efficient acoustical dampening, to be integrated into the head plate of a combustion chamber. Usually, dampers optimized for low frequencies require large construction volume. The arrangement here used enables the construction space existing in a combustion chamber to be effectively utilized, thus enabling broad-band dampening in the low-frequency range (frequencies below 2000 Hz) in particular. For this, the usually low broad-band dampening effect of perforated walls is combined with the large effect of a Helmholtz resonator. Skillfully utilizing the volume between the combustion chamber heads to approach to a plenum-like flow for the dampening holes enables a particularly high dampening effect to be achieved. This enables the even high dampening effect of a Helmholtz resonator to be far exceeded.

While a small distance between the two walls is required on usual, double-walled configurations to provide for an adequate cooling effect, the arrangement according to the present invention merely requires a convective cooling concept for the thermally loaded wall.

Summarizing, then, the solution according to the present invention combines the conflicting requirements on the cooling and dampening layout by simple and workable means. It enables a large volume to be integrated into a double-wall arrangement, while obtaining a high cooling effect by way of a changed flow into the volume.

List of reference numerals

| | |
|---|---|
| 101 | Combustion chamber |
| 102 | Burner with arm and head |
| 103 | Bypass flow |
| 104 | Fan |
| 105 | Compressor |
| 106 | Compressor stator wheel |
| 107 | Inner combustion chamber casing |
| 108 | Outer combustion chamber casing |
| 109 | Turbine stator wheel |
| 110 | Turbine rotor wheel |
| 111 | Drive shaft |
| 112 | Combustion chamber head |
| 201 | Fin/partition wall |
| 202 | Exit hole/recess/bore hole |
| 203 | Entry hole/recess/bore hole |
| 204 | Combustion chamber wall |
| 205 | Attaching element |
| 206 | Combustion chamber-opposite confinement (wall) |
| 207 | Combustion chamber head volume/dampening volume |
| 208 | Burner axis |
| 209 | Sealing element |
| 210 | Combustion chamber-side confinement (wall) |
| 211 | Combustion chamber wall cooling holes |
| 212 | Outer sidewall of combustion chamber head |
| 213 | Inner sidewall of combustion chamber head |
| 213b | Front portion of inner sidewall of combustion chamber head |
| 214 | Gap |
| 215 | Supply hole for initial cooling film |

-continued

List of reference numerals

| | |
|---|---|
| 216 | Groove for retransmitting initial cooling film |
| 217 | Effusion hole |
| 218 | Flow duct |
| 219 | Flow duct cover |
| 220 | Heat-transfer augmenting element |
| 221 | Combustion chamber inner wall |
| 222 | Bore hole in combustion chamber inner wall |
| 223 | Bore hole in combustion chamber outer wall |
| 224 | Flow duct |
| 225 | Volume between combustion chamber outer and inner walls |
| 226 | Combustion chamber outer wall |
| 227 | Fin element, aerodynamic profile |
| 228 | Fin element, circular profile |

What is claimed is:

1. A combustion chamber head of a gas turbine, comprising:

a confinement enclosing a dampening volume including a combustion chamber-side wall positioned toward the combustion chamber and a opposing wall positioned away from the combustion chamber, wherein the combustion chamber-side wall includes bore holes, the confinement including at least one entry hole whereby, in an edge area of the combustion chamber-side wall, a flow of cooling air is routed onto the combustion chamber-side wall, and further including at least a third wall that separates this flow of the cooling air, which flows along the combustion chamber-side wall, from a crossing flow of the cooling air through the bore holes in the combustion chamber-side wall without the two cooling air flows mixing with one another;

wherein the combustion chamber-side wall is constructed and arranged to route the flow of the cooling air via a side of the combustion chamber-side wall that faces away from the combustion chamber, to subsequently reroute the flow of the cooling air into the dampening volume and to subsequently issue the flow of the cooling air into the combustion chamber via the bore holes;

wherein the combustion chamber-side wall includes, on the side that faces away from the combustion chamber, elements enlarging a heat transfer surface;

wherein the bore holes extend through the elements enlarging the heat transfer surface such that the elements enlarging the heat transfer surface make up at least a portion of the at least a third wall.

2. The combustion chamber head of claim 1, wherein the elements enlarging the heat transfer surface are configured as at least one chosen from fins, cuboids, profiled webs, cylindrical pins and profiled pins.

3. The combustion chamber head of claim 2, wherein the bore holes extend through the elements enlarging the heat transfer surface essentially parallel to an axis of symmetry of a head of a burner through a surface of the combustion chamber-side wall.

4. The combustion chamber head of claim 2, wherein the bore holes extend through the elements enlarging the heat transfer surface essentially normal to a local surface on a side of the combustion chamber-side wall that faces the combustion chamber at an air exit point from the bore holes into the combustion chamber.

5. The combustion chamber head of claim 2, wherein the bore holes extend through the elements enlarging the heat transfer surface at an angle of 10 to 90 degrees to a local surface on a side of the combustion chamber-side wall that faces the combustion chamber at an air exit point from the bore holes into the combustion chamber.

6. The combustion chamber head of claim 5, wherein a flow direction of the cooling air entering via the entry hole is inclined at an angle (13) to a plane of the combustion chamber-side wall.

7. The combustion chamber head of claim 6, wherein, at an inner sidewall of the combustion chamber head, the cooling air is directed radially outwards in a direction of an outer sidewall of the combustion chamber head.

8. The combustion chamber head of claim 7, and further comprising a cover covering between adjacent elements enlarging the heat transfer surface to form a partly closed flow duct for the cooling air.

9. The combustion chamber head of claim 8, wherein the partly closed flow duct includes additional flow obstacles for the cooling air.

10. The combustion chamber head of claim 9, wherein the combustion chamber head includes additional separating walls in a circumferential direction for segmenting the dampening volume into individual volumes confined from each other.

11. The combustion chamber head of claim 10, wherein an exit area from the bore holes is larger by a factor of 2-10 than an exit area of the at least one entry hole.

12. The combustion chamber head of claim 11, and further comprising additional bore holes provided in the combustion chamber wall, which connect a groove in an outer sidewall of the combustion chamber head to the combustion chamber.

13. The combustion chamber head of claim 11, and further comprising a flow duct connecting the dampening volume to a hollow space formed between a combustion chamber outer wall and a combustion chamber inner wall.

* * * * *